US006213369B1

(12) United States Patent
Kato

(10) Patent No.: US 6,213,369 B1
(45) Date of Patent: Apr. 10, 2001

(54) MATERIAL FEEDING APPARATUS

(75) Inventor: Heizaburo Kato, Shizuoka-ken (JP)

(73) Assignee: Sankyo Seisakusho Co. (JP)

( * ) Notice: Subject to any disclaimer, the term of this patent is extended or adjusted under 35 U.S.C. 154(b) by 0 days.

(21) Appl. No.: 09/422,694

(22) Filed: Oct. 21, 1999

(30) Foreign Application Priority Data

Oct. 27, 1998 (JP) ..... 10-305202

(51) Int. Cl.[7] ..... B65H 20/00; B65H 23/06
(52) U.S. Cl. ..... 226/162; 226/149; 226/167
(58) Field of Search ..... 226/141, 142, 226/149, 151, 162, 167

(56) References Cited

U.S. PATENT DOCUMENTS 2,763,365 * 9/1956 Pulman ..... 226/141
4,819,850 * 4/1989 Kato ..... 226/162
5,632,430 * 5/1997 Kato ..... 226/149
5,769,300 * 6/1998 Aono ..... 226/149 X

FOREIGN PATENT DOCUMENTS 60-27549 8/1985 (JP) .
63-82271 4/1988 (JP) .

* cited by examiner

*Primary Examiner*—Michael R. Mansen
(74) *Attorney, Agent, or Firm*—Harness, Dickey & Pierce P.L.C.

(57) ABSTRACT

A material feeding apparatus has gripper apparatuses which perform clamping and unclamping operations of a material by means of a stationary gripper and a movable gripper, and a sliding block which can support the first gripper apparatus and oscillate in a transfer direction of the material. These members are respectively driven by first, second and third cams which are fixed to an input shaft. In order to closely attach transfer members interposed between the first cam performing a forwarding operation of the material and the sliding block to each other, a spring which always urges the sliding block in a returning direction is provided. Accordingly, it is possible to remove a play between the transfer members and perform a feeding operation at a high speed and a high accuracy. Therefore, it is possible to obtain a material feeding apparatus which can transfer and supply the material at a high speed and a high accuracy.

2 Claims, 10 Drawing Sheets

MATERIAL FEEDING APPARATUS

BACKGROUND OF THE INVENTION

1. Field of the Invention

The present invention relates to a material feeding apparatus, and particularly to an apparatus which intermittently feeds a material such as a sheet material, a wire material and the like to a working machine such as a press machine and the like at every fixed amounts.

2. Description of the Related Art

As an apparatus which feeds a material such as a sheet material, a wire material and the like to a working machine such as a press machine and the like, for example, Japanese Utility Model Examined Publication 60-27549 has been conventionally known. The apparatus is provided with a first gripper apparatus structured such as to perform a material clamping (gripping) operation and a material unclamping (releasing) operation between a first stationary gripper and a first movable gripper, and a second gripper apparatus disposed on a sliding block capable of oscillating along a transfer path of the material and structured such as to perform material clamping and unclamping operations between a second stationary gripper and a second movable gripper, and performs the material clamping and unclamping operation and the sliding block sliding operation by means of the first and second gripper apparatuses at a predetermined timing with using a cam apparatus, a swinging arm and the like.

In this case, since the apparatus is structured such as to control both of the first gripper and the second gripper by the single swinging arm which is swung by the single cam so as to perform the material clamping and unclamping operation by the first gripper apparatus and the second gripper apparatus, there has been a problem that it is hard to suitably set a timing of the operation of the first gripper apparatus and the second gripper apparatus. Particularly, it is impossible to design such that both of the first and second gripper apparatuses temporarily clamp the material at a starting time and a finishing time of each one of the material intermittent feedings, whereby the material is prevented from becoming a free state, so that it is hard to improve a feeding accuracy and make the feeding high-speed.

Then, in order to solve the problem, the applicant of the present application proposed Japanese Patent Unexamined Publication No. 63-82271. This apparatus respectively drives the first and second gripper apparatuses and the sliding block by independent cams so as to prevent a free state in which the material is not fully clamped from being generated during all the period of the material feeding operation, thereby making a high-speed and high-accuracy material feeding possible.

However, even the apparatus proposed by the applicant can not always satisfy a requirement with respect to the feeding accuracy and the feeding speed which have been required for this kind of feeding apparatus in recent days.

That is, in recent years, electronic information devices such as a portable telephone, a personal computer and the like are significantly spread, however, while these devices become compact and inexpensive, in a production field, in order to correspond to making parts compact and high-density, a feeding (a positioning of the material) at significantly higher accuracy than the conventional one is going to be desired. Further, in order to satisfy the requirement for improving a productivity, reducing a cost, mass production and the like, it is desired to provide an apparatus which can be operated at higher speed.

For example, in a press working industry, a requirement with respect to a high-speed operation has been increased year by year, and there is provided a press machine which can operate at two or three times higher speed than that of the conventional apparatus proposed by the applicant. However, in a current status, a feeding apparatus for supplying a material to the press machines does not always correspond to the operation speed of the press machine.

SUMMARY OF THE INVENTION

An object of the present invention is to provide a feeding apparatus which can transfer and supply a material at higher speed and higher accuracy.

In order to achieve the object mentioned above and solve the problem, in accordance with a first aspect of the present invention, there is provided a material feeding apparatus comprising:

a first gripper apparatus which performs material clamping and unclamping operations by a first stationary gripper and a first movable gripper;

a second gripper apparatus which performs material clamping and unclamping operations by a second stationary gripper and a second movable gripper;

a sliding block which supports the first gripper apparatus and can oscillate in a material transfer direction;

a cam apparatus having a first cam which is fixed to an input shaft continuously rotated in one direction and has a predetermined cam surface shape for converting a rotating motion of the input shaft into a linear motion of the sliding block, a second cam which is fixed to the input shaft and moves the first movable gripper between a clamping position at which the first movable gripper is moved near the first: stationary gripper and an unclamping position at which the first movable gripper is moved apart from the first stationary gripper and a third cam which is fixed to the input shaft and moves the second movable gripper between a clamping position at which the second movable gripper is moved near the second stationary gripper and an unclamping position at which the second movable gripper is moved apart from the second stationary gripper;

a first gripper sliding apparatus having a swinging arm which swings in correspondence to a rotation of the first cam, and connecting means which operatively connects the swinging arm to the sliding block so as to convert a swing motion of the swinging arm into a linear motion of the sliding block;

a first gripper operating apparatus which operatively connects the second cam to the first movable gripper;

a second gripper operating apparatus which operatively connects the third cam to the second movable gripper; and first urging means which always urges so that the sliding block, the connecting means and the swinging arm are closely connected to each other along a transfer path of a force from the first cam to the sliding block.

Further, in accordance with a second aspect of the present invention, there is provided a material feeding apparatus in the first aspect of the present invention, wherein the first gripper sliding apparatus is provided with a turret which swingably supports the swinging arm, and a cam follower which is rotatably placed in the turret and rotates a cam surface of the first cam, the connecting means includes a sliding barrel which is placed in the swinging arm in such a manner as to change a distance from a center of rotation of the swinging arm, and a connecting member which is rotatably and slidably brought into contact with the sliding barrel so as to connect the swinging arm to the sliding block via the sliding barrel, the first gripper operating apparatus is provided with a first movable gripper supporting rod which is placed in the sliding block in such a manner as to move between the clamping position and the unclamping position, and a first lift arm which swings together with the rotation of the second cam so as to move the first movable gripper supporting rod forward and rearward, the first movable gripper supporting rod is provided with second urging means which urges the rod toward an engaging surface of the first lift arm, and a rolling element which is brought into rolling contact with the engaging surface of the first lift arm in such a manner as to move together with the sliding block, in one end portion thereof, the second gripper operating apparatus is provided with a second movable gripper supporting rod which is placed in an apparatus housing in such a manner as to move between the clamping position and the unclamping position, and a second lift arm which swings together with a rotation of the third cam so as to move the second movable gripper supporting rod forward and rearward, the first and second lift arms have cam followers which are respectively brought into rolling contact with the second and third cams, and third urging means which respectively urge these cam followers toward the second and third cams, and the first urging means includes a spring which urges the sliding block in any one of a feeding direction and a returning direction of the material.

The applicant of the present application has considered the conventional apparatus including the proposed apparatus (Japanese Patent Unexamined Publication No. 63-82271) mentioned above, in order to further improve the material feeding accuracy and increase the feeding speed. As a result, the applicant found that the conventional apparatus had problems which prevent a further improvement of an accuracy and realization of a high speed, in view that many sliding mechanisms are used for the clamping and unclamping operation and the feeding operation of the gripper and the feeding at a desired accuracy is performed by completely holding the motion of the gripper in accordance with a shape of the elements. In order to perform the oscillating operation by means of this kind of hold type apparatus construction, a slight gap (play/backlash) is necessarily required between the parts, and this play generates a slight error in feeding. Accordingly, the applicant eagerly endeavors for developing a operating mechanism in place of the hold type apparatus construction, and as a result, provides the present invention.

A material feeding apparatus in accordance with the present invention supplies (feeds) a material basically by repeating a series of operations that material holding members (a stationary gripper and a movable gripper) called grippers grip (clamp) the material, for example, in a vertical direction, move in a feeding direction, release (unclamp) the material there and thereafter return to an original position.

However, in the apparatus in accordance with the present invention, only one of the forwarding and returning operations is performed by a hold type driving system by means of cams, and another operation (returning or forwarding) is performed by using an elastic force of urging means (for example, a spring).

That is, the apparatus in accordance with the present invention is provided with the first gripper apparatus and the second gripper apparatus which clamp and unclamp the material, and each of the gripper apparatuses has the stationary gripper and the movable gripper which moves forward and rearward with respect to the stationary gripper so as to clamp the material. The first gripper apparatus is arranged on the sliding block which can oscillate in the transfer direction of the material, and accordingly, the first gripper apparatus performs an oscillating motion together with the sliding block in addition to the clamping and unclamping operation of the material, thereby feeding the material. The first and second gripper apparatuses and the sliding block are driven by three cams (the first cam, the second cam and the third cam) which are fixed to the input shaft continuously rotated in one direction.

The first cam has a predetermined cam surface shape for converting the rotating motion of the input shaft into the linear motion of the sliding block, the second cam and the third cam has a predetermined cam surface shape for moving the movable gripper (the first movable gripper and the second movable gripper) of the respective gripper apparatuses between the clamping position at which the movable grippers (the first and second movable grippers) are moved near the stationary grippers (the first stationary gripper and the second stationary gripper) of the respective gripper apparatuses and the unclamping position at which the movable grippers are moved apart from the stationary grippers.

The first cam and the sliding block are connected to each other by the first gripper sliding apparatus provided with the swinging arm which swings together with the rotation of the first cam and the connecting means which converts the swinging motion of the arm into the linear motion of the sliding block, whereby the sliding block slides at a predetermined timing due to the rotation of the input shaft, so that the first gripper apparatus performs the material forwarding and returning operations.

The swinging arm is, preferably as the second aspect in accordance with the present invention, rotatably supported by a suitable rotary shaft and fixed on the turret provided with the cam follower for rolling the cam surface of the first cam. Further, in the swinging arm fixed on the turret in the manner mentioned above, the sliding barrel arranged in such a manner as to change the distance from the rotary shaft (the center of rotation of the swinging arm) is provided and the swinging arm and the sliding block are connected by the connecting member rotatably and slidably brought into contact with the sliding barrel in one end portion, whereby the connecting means stated in the first aspect in accordance with the present invention can be constructed.

The arranging position of the sliding barrel is set to be changeable because the operation stroke of the sliding block can be easily adjusted by enabling the connecting point between the swinging arm and the sliding block (the connecting member) to shift. For example, when shifting the sliding barrel in a direction of the front end of the swinging arm so as to move apart from the center of rotation of the swinging arm, it is possible to increase the moving distance of the sliding block so as to increase the feeding amount of the material. On the contrary, when moving the sliding barrel near the center of rotation of the swinging arm, it is possible to reduce the moving distance of the sliding block so as to reduce the feeding amount of the material.

In the apparatus in accordance with the present invention, there is provided with first urging means which urges so that the respective connections among the sliding block, the connecting means and the swinging arm become close with each other along the force transfer path from the first cam to the sliding block. By providing this urging means so as to always closely attach the members disposed from the first cam to the sliding block to each other during the operation, it is possible to apply an accurate feeding displacement given by a cam curve of the first cam to the first gripper apparatus. For example, since the members are always closely attached to each other by the urging means during a series of forwarding and returning operations even when any play exist between the first cam and the connecting means or between the members contained in the connecting means, the apparatus is not influenced by the play, so that a feeding at a high accuracy can be performed.

In this case, "the respective connections become close with each other" means that the members are always under a tensional state (a state of not generating a shift) in the force transmitting direction, and does not always mean only pressing the members to each other. Because it is possible to cancel the feeding error caused by the play between both the members as far as the members are always under the tensioned relation during a series of forwarding and returning operations even when urging the members in a tensioning direction.

In the second aspect in accordance with the present invention, the structure is made such that the first urging means is constituted by a spring and the sliding block is urged by the spring in any one of the forwarding direction and the returning direction. In this case, since a larger force is required in the forwarding operation in comparison with the returning operation, as an embodiment mentioned below, it is preferable to urge the sliding block in the returning direction so as to perform the forwarding operation by the rotational torque of the first cam and perform the returning operation by an elastic force of the spring.

On the contrary, the first and second gripper apparatus which perform the clamping and unclamping operations of the material, and the second and third cams driving them are respectively connected by the first gripper operating apparatus and the second gripper operating apparatus. These operating apparatuses transmit the predetermined motions on the basis of the respective cam surface shapes of the second cam and the third cam to the movable gripper of the first gripper apparatus and the movable gripper of the second gripper apparatus.

In the second aspect in accordance with the present invention, each of the first and second gripper operating apparatuses is provided with the movable gripper supporting rod and the lift arm. These movable gripper supporting rods are arranged in the sliding block or the apparatus housing so as to be movable between the clamping position and the unclamping position, and urged toward the engaging surface of the lift arm by the second urging means. On the contrary, the lift arm is provided with the cam follower which is brought into rolling contact with the second cam or the third cam, and provided with the third urging means which presses the cam follower to the second cam or the third cam, thereby swinging together with the rotation of the cam. Accordingly, the first movable gripper and the second movable gripper moves forward and rearward with respect to the first and second stationary grippers at a predetermined timing on the basis of the cam surface shapes of the second cam and the third cam, so as to perform each of the clamping and unclamping operations of the material.

Further, the first gripper apparatus is oscillated in the transfer direction of the material together with the sliding block as mentioned above, however, in order to enable the operation, the first movable gripper supporting rod is provided with the rolling element which is brought into rolling contact with the engaging surface of the first lift arm at one end portion thereof. It is possible to easily move the first gripper apparatus in the forwarding direction and the returning direction while maintaining the clamping or unclamping state by means of the gripper by bringing the first movable gripper supporting rod into rolling contact with the first lift arm. In this case, it is preferable that the contact system between the first movable gripper supporting rod and the lift arm mentioned above is performed by the rolling contact in the manner stated in claim 2 in view of reducing the operation resistance of the sliding block, however, the structure can be made such that a suitable sliding member is provided in place of the rolling element so as to be brought into sliding contact therewith.

Further, the second and third urging means mentioned above can be constituted by, for example, a spring (a coil spring, a plate spring and the like) in the same manner as the first urging means mentioned above.

As mentioned above, in accordance with the material feeding apparatus of the present invention, in comparison with the conventional apparatus, it is possible to feed and supply the material at a higher speed and at a higher accuracy.

DESCRIPTION OF THE PREFERRED EMBODIMENT

Figure 1:
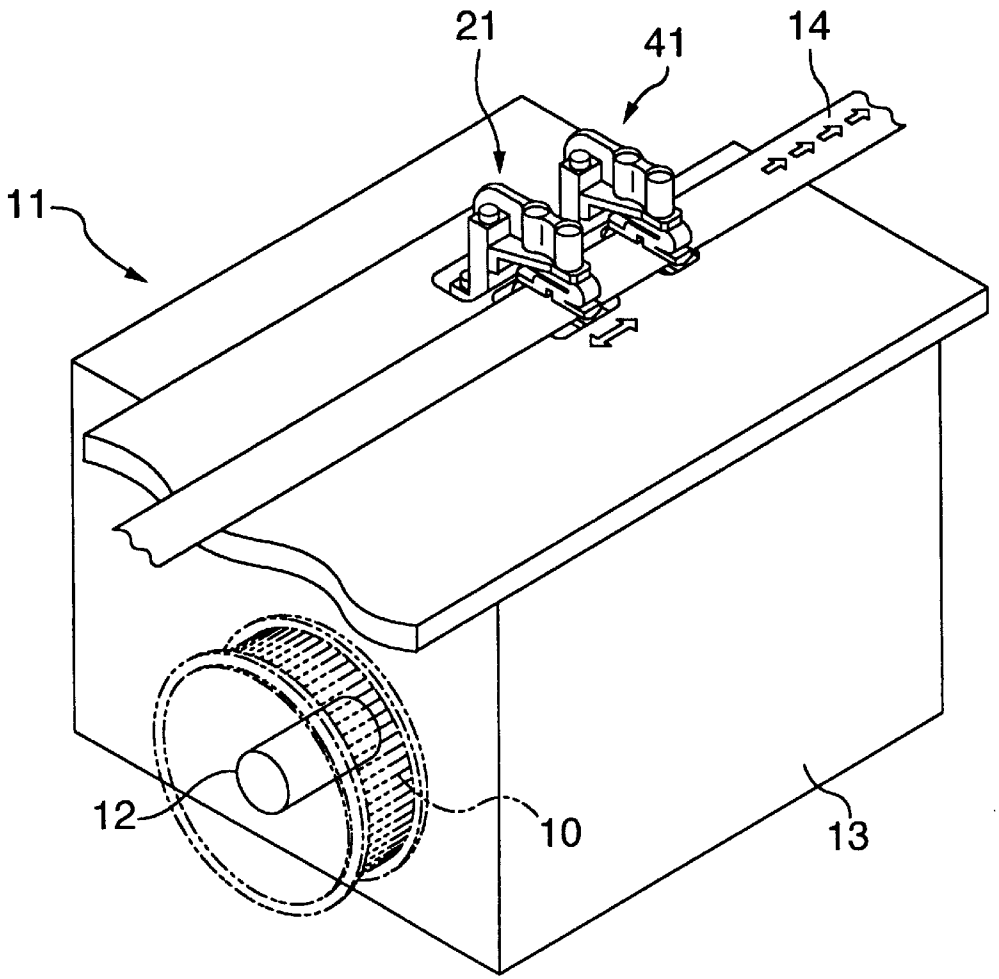
FIG. 1 is a schematically perspective view which shows an outer appearance of a material feeding apparatus in accordance with an embodiment of the present invention.
Figure 2:
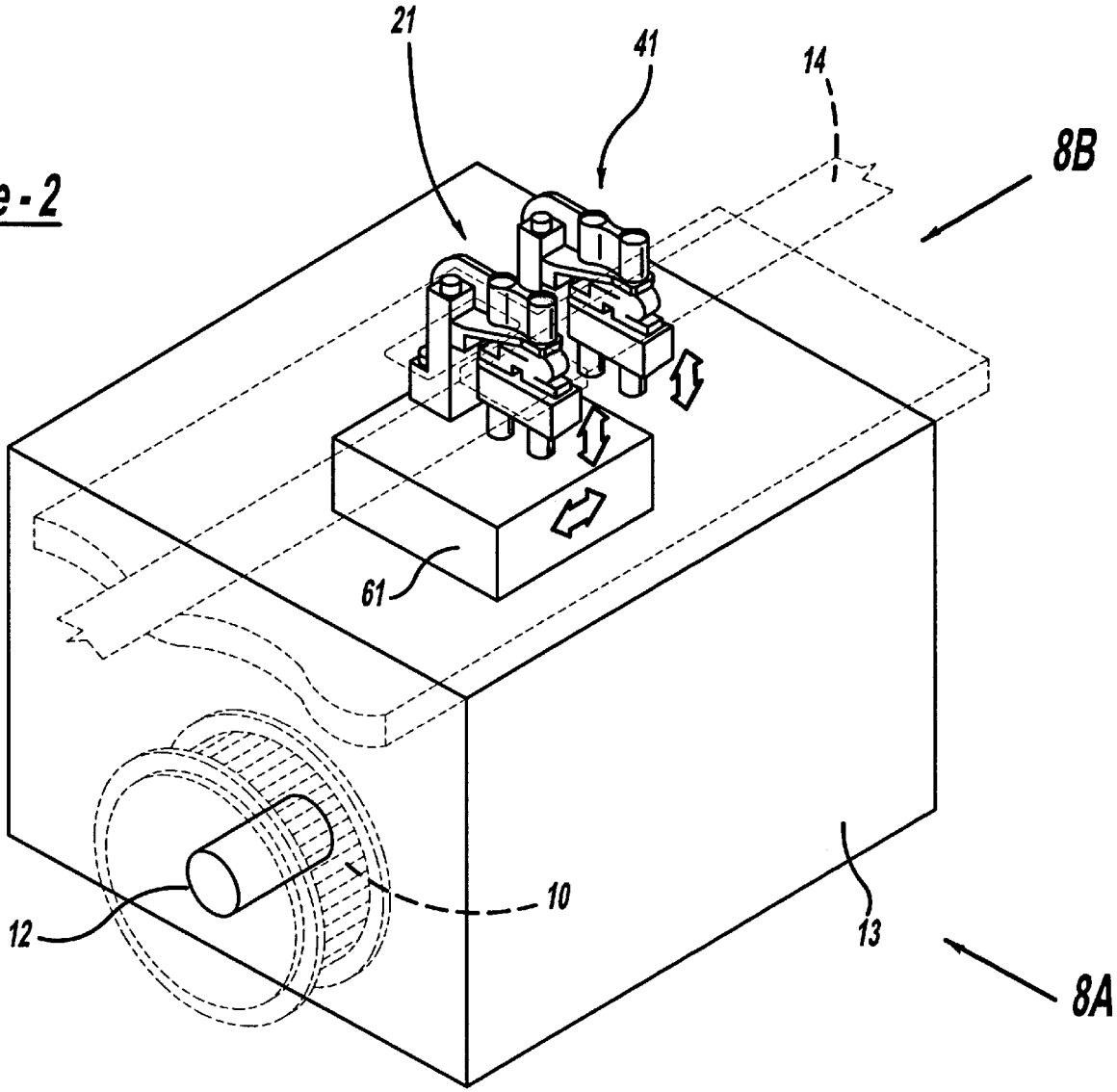
FIG. 2 is a perspective view which schematically shows a part of an inner structure of the feeding apparatus in accordance with the embodiment.

An embodiment in accordance with the present invention will be described below with reference to the accompanying drawings. FIGS. 1 to 5 and FIGS. 6A to 8B respectively show a structure and an operation of a feeding apparatus in accordance with an embodiment of the present invention.

As shown in these drawings, a feeding apparatus 11 is provided with a first gripper apparatus 21 and a second gripper apparatus 41 which respectively have stationary grippers 22 and 42 and movable gripper 23 and 43 and perform a clamping (gripping) operation and an unclamping (releasing) operation of a material 14, and is structured such as to supply the material 14 to a working machine, for example, a press apparatus 91 in accordance with an intermittent feeding operation. A particular structure of each of portions of the apparatus will be described later, however, a basic operation of the feeding apparatus 11 will be at first described with reference to FIG. 6.

Figures 6A, 6B, 6C, 6D:
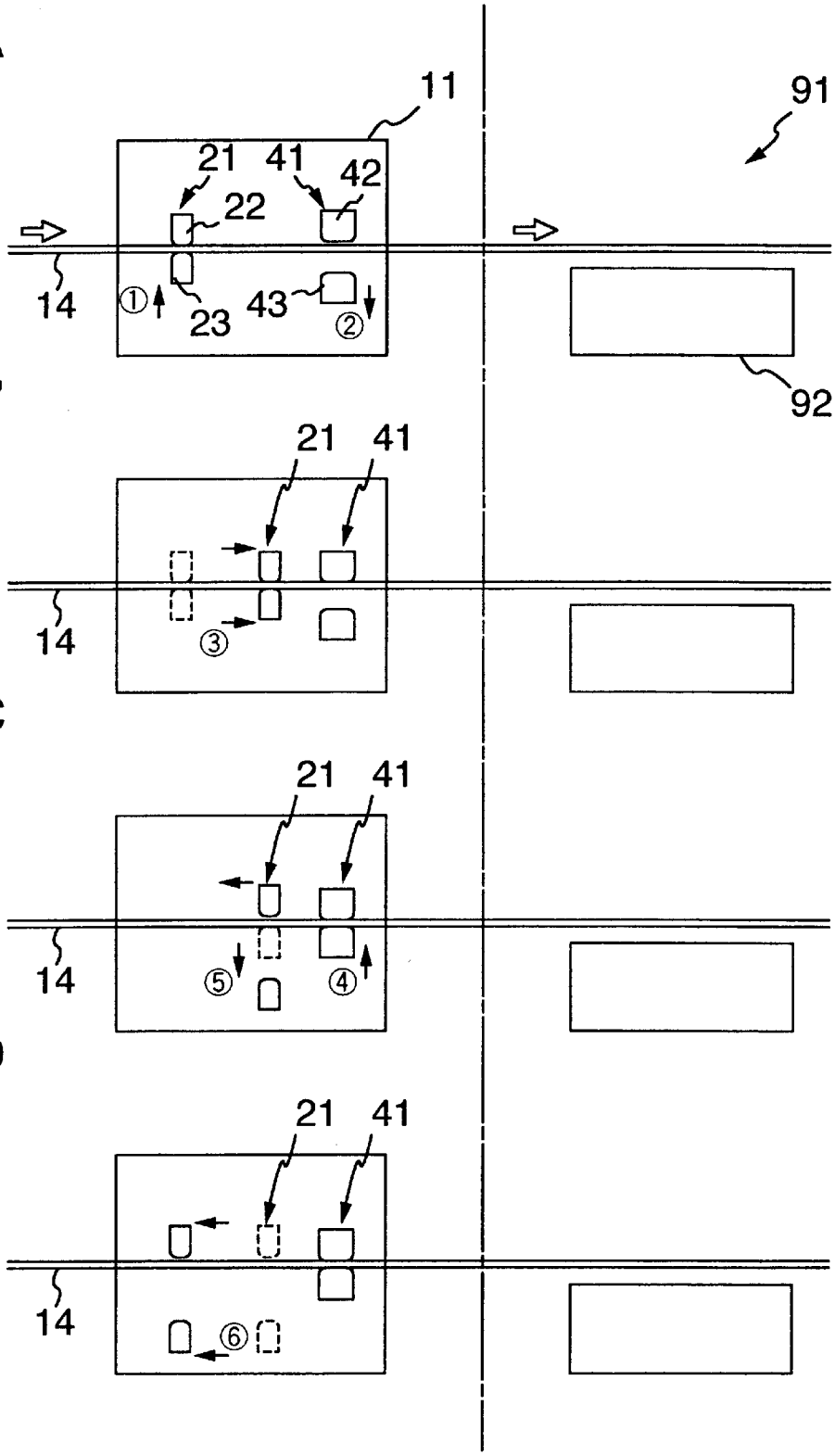
FIG. 6A is a notional view which shows an operation of the feeding apparatus in accordance with the embodiment (at a time of starting a forwarding operation)
FIG. 6B is a notional view which shows an operation of the feeding apparatus in accordance with the embodiment (at a time of finishing a forwarding operation)
FIG. 6C is a notional view which shows an operation of the feeding apparatus in accordance with the embodiment (at a time of starting a returning operation)
FIG. 6D is a notional view which shows an operation of the feeding apparatus in accordance with the embodiment (at a time of finishing a returning operation)

The feeding apparatus 11 is operated as shown in FIG. 6A such that at first (1) the first gripper apparatus 21 clamps the material, and (2) the second gripper apparatus 41 unclamps the material 14. Next, as shown in FIG. 6B, (3) the first gripper apparatus 21 moves in a forwarding direction of the material 14 (in a rightward direction in the drawing), whereby the material 14 clamped by the first grippers 22 and 23 is forwarded to the press apparatus 91. Next, (4) as shown in FIG. 6C, the second gripper apparatus 41 clamps the material 14 and thereafter, (5) the first gripper apparatus 21 unclamps the material 14. (6) As shown in FIG. 6D, the first gripper apparatus 21 moves in a returning direction (in a leftward direction in the drawing) and returns to an original position.

It is possible to supply the material 14 to the press 91 (a metal mold 92) by repeating these series of operations (1) to (6). In this case, the first gripper apparatus 21 is placed on a sliding block 61 (not illustrated in FIGS. 6A to 6D) arranged in such a manner as to oscillate in a transfer direction of the material 14, an oscillating operation (forwarding and returning operations) of the first gripper apparatus 21 is performed by moving the sliding block 61.

Figure 3:
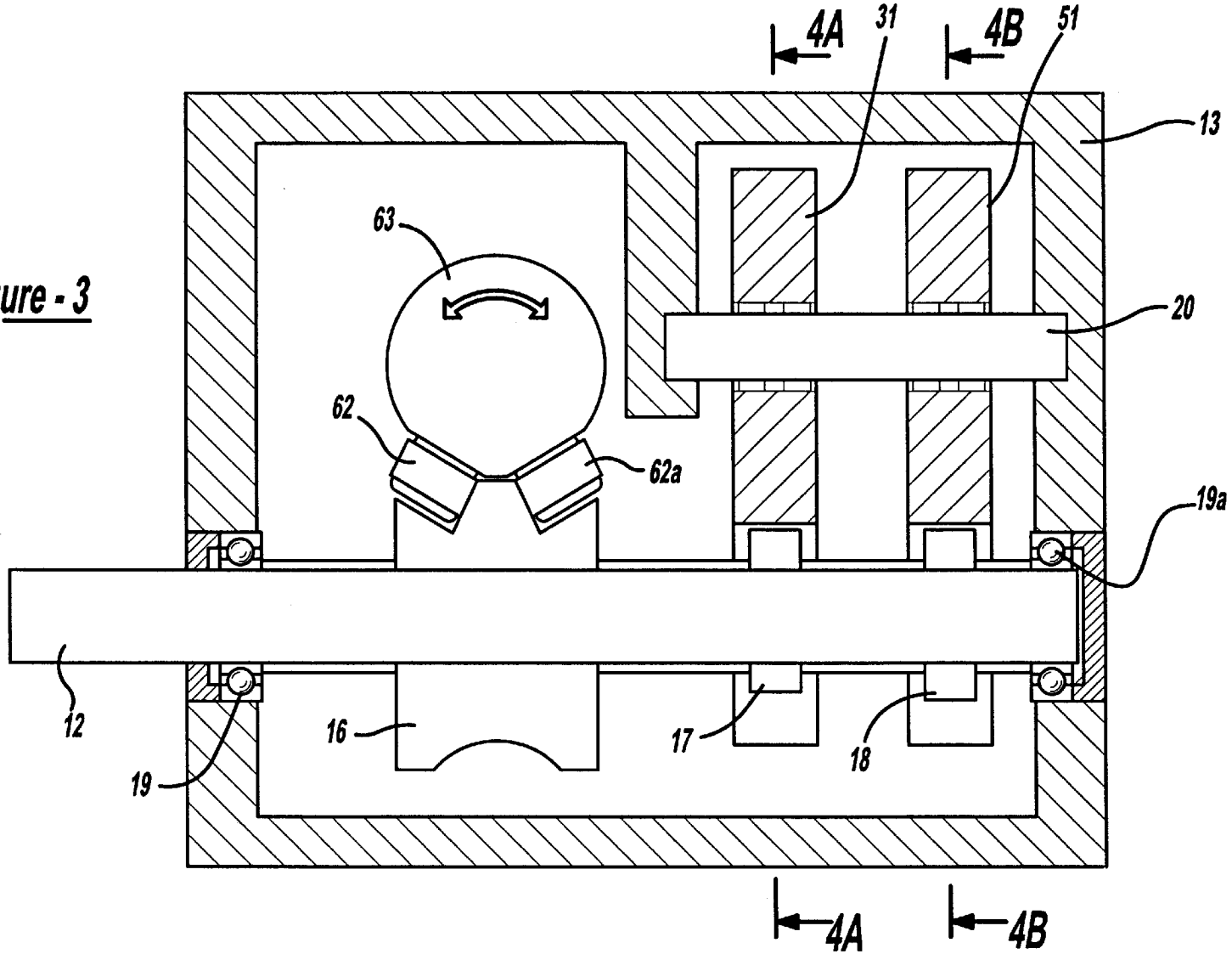
FIG. 3 is a horizontal cross sectional view which shows an inner structure of the feeding apparatus in accordance with the embodiment.
Figure 4A:
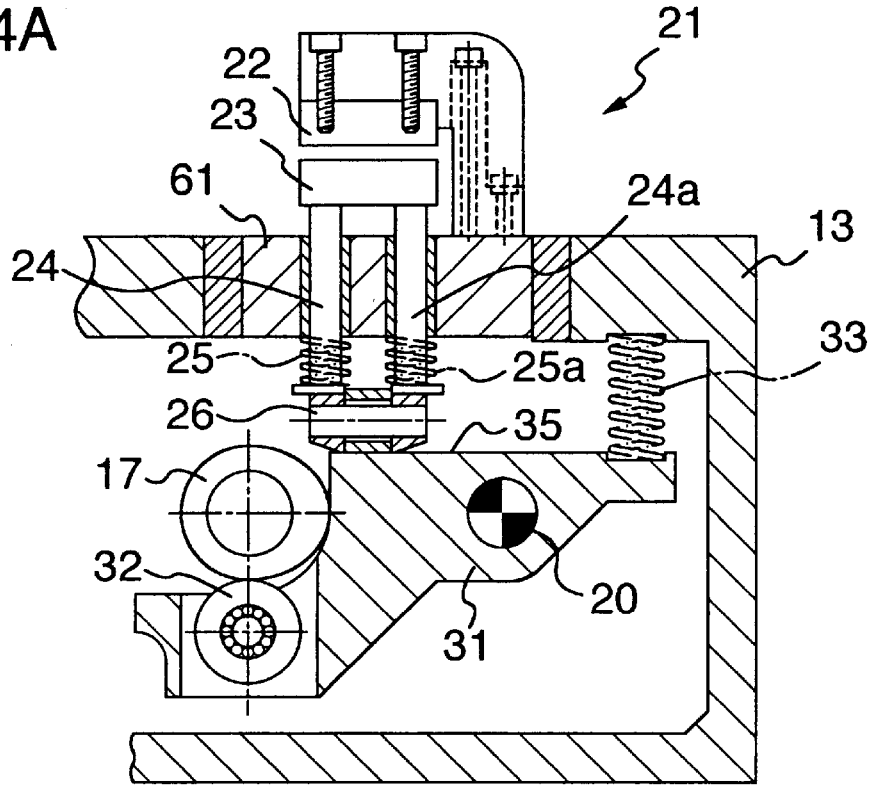
FIG. 4A is a cross sectional view along a line 4A—4A in FIG. 3.
Figure 4B:
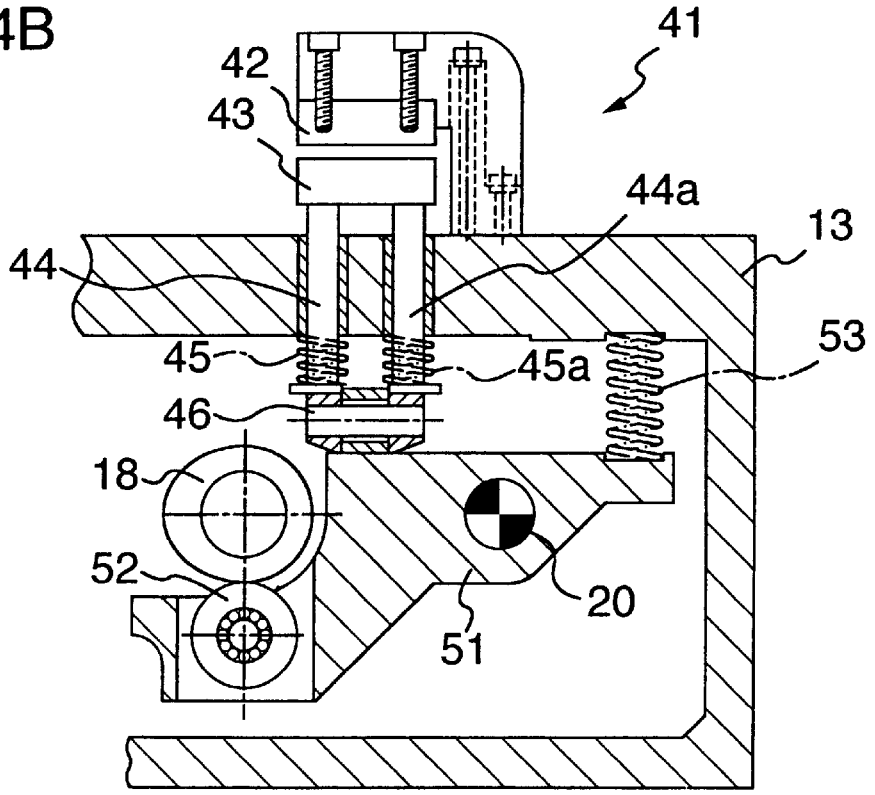
FIG. 4B is a cross sectional view along a line 4B—4B in FIG. 3.
Figure 5:
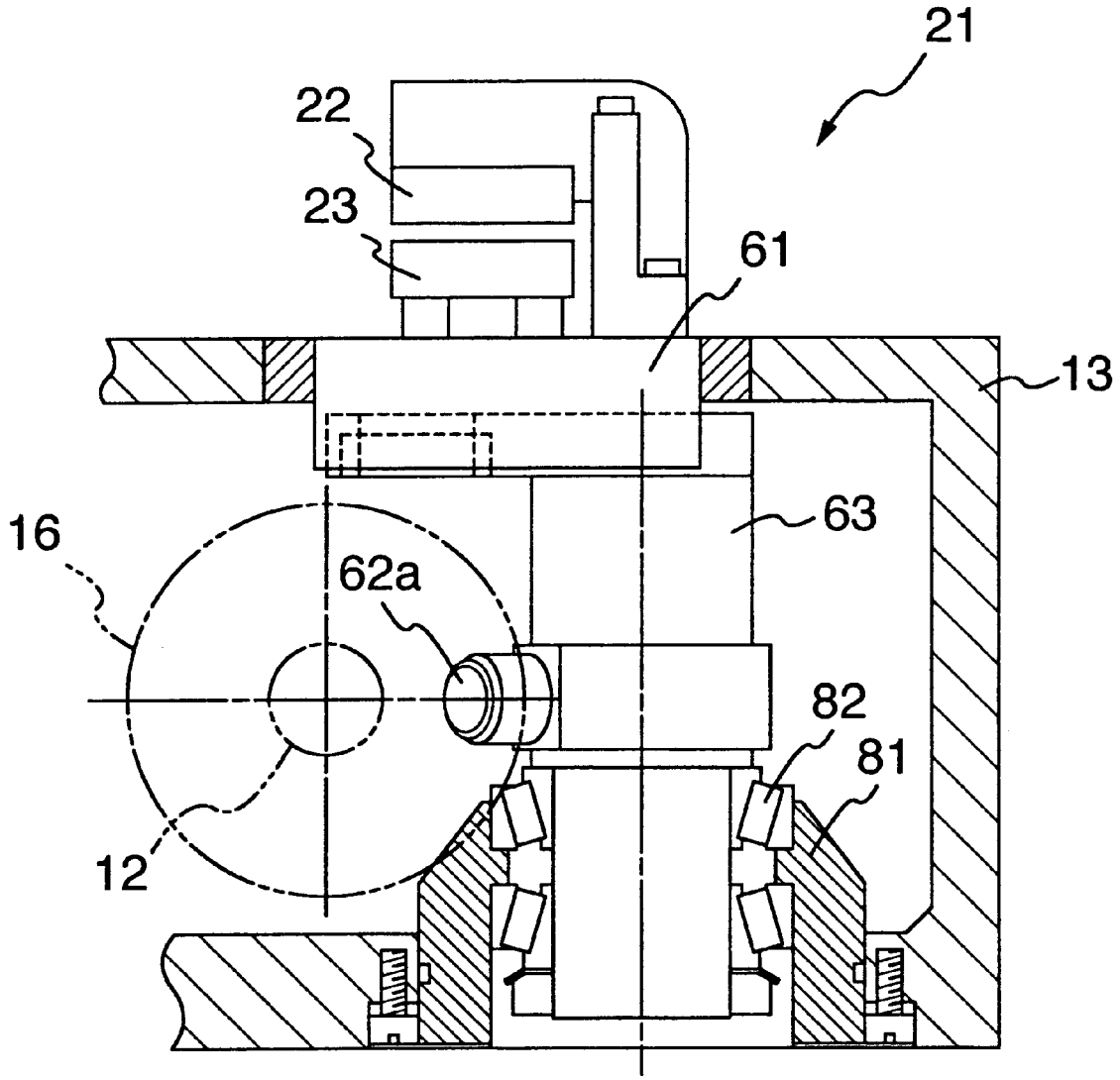
FIG. 5 is a vertical cross sectional view which shows an inner structure of the feeding apparatus in accordance with the embodiment.

Next, a description will be given of a particular structure and an operation of each of portions in the apparatus mainly with reference to FIGS. 1 to 5, 7A, 7B, 8A and 8B. The apparatus 11 is provided with a cam apparatus having three cams (a first cam 16, a second cam 17 and a third cam 18) subsequently fixed to an input shaft 12 as shown in FIG. 3, so as to make the first gripper apparatus 21, the second gripper apparatus 41 and the sliding block 61 to perform the predetermined operation mentioned above. The input shaft 12 is fixed to an apparatus housing 13 via bearings 19 and 19*a*, a rotation is transmitted from a crank shaft of the press machine via a timing belt, a pulley 10 and the like at a predetermined timing, and the present apparatus 11 is simultaneously operated with the press machine by being continuously rotated in one direction.

On the contrary, the first cam 16 forms a taper-like rib on a peripheral surface for converting a rotating motion of the input shaft 12 into a linear motion of the sliding block 61, and constitutes a roller gear cam having both side surfaces of the taper rib as a cam surface. The second cam 17 and the third cam 18 are respectively constituted as plate cams setting peripheral surfaces to cam surfaces formed in a predetermined shape for moving the movable grippers 23 and 43 between a clamping position at which the movable gripper 23 and 43 are moved near the stationary grippers 22 and 42 and an unclamping position at which the movable grippers 23 and 43 are moved apart from the stationary grippers 22 and 42.

In this case, the structure is made such that the operations (the oscillating operation of the first gripper apparatus 21, the clamping and unclamping operation of the first gripper apparatus 21 and the clamping and unclamping operation of the second gripper apparatus 41) necessary for feeding the material 14 are performed by three independent cams 16 to 18 as mentioned above, because a timing design of each of the portions (each of the operations) can be easily performed.

The first gripper apparatus 21 is fixed on the sliding block 61. The sliding block 61 is placed in the apparatus housing 13 in such a manner as to oscillate in a transfer direction of the material 14, and accordingly the first gripper apparatus 21 performs an oscillating operation together with the sliding block 61.

Figure 7A:
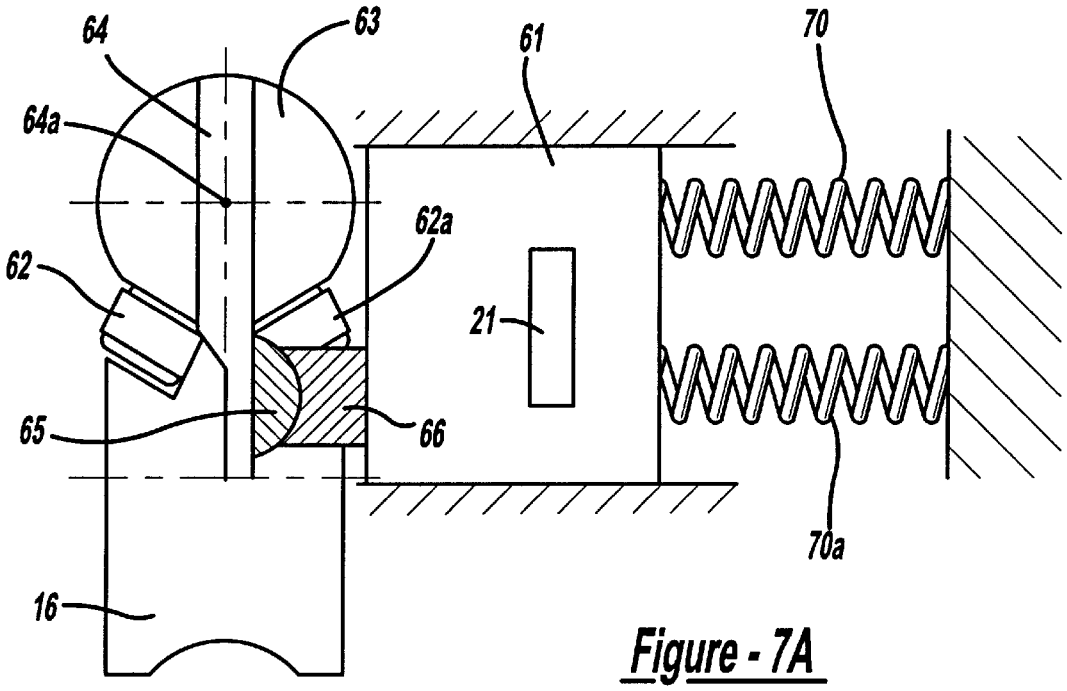
FIG. 7A is a plan view which shows a forwarding operation (a state before forwarding) in the feeding apparatus in accordance with the embodiment.
Figure 7B:
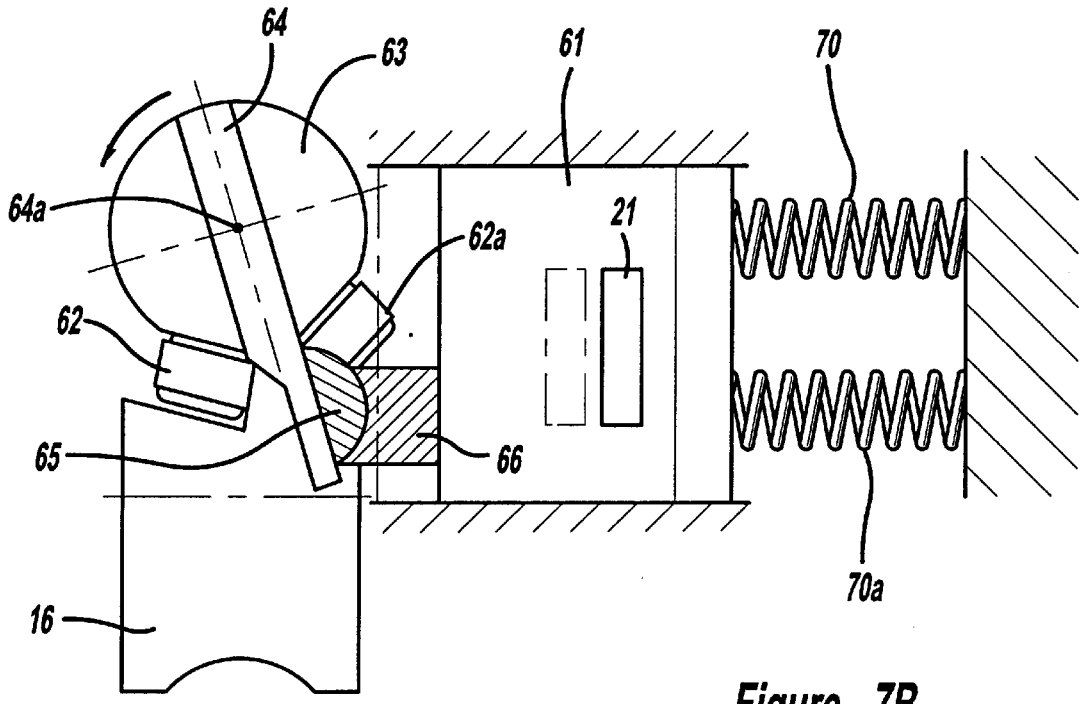
FIG. 7B is a plan view which shows a forwarding operation (a state after forwarding) in the feeding apparatus in accordance with the embodiment.
Figure 8A:
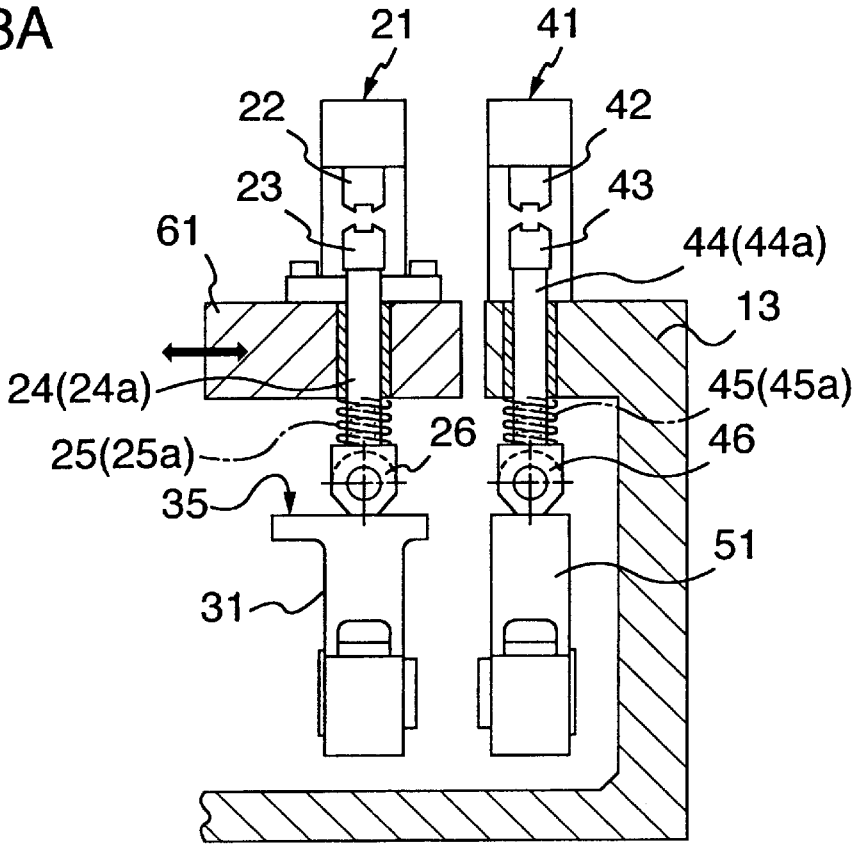
FIG. 8A is a vertical cross sectional view which shows an inner structure of the feeding apparatus in accordance with the embodiment as seen from an 8A direction in FIG. 2.
Figure 8B:
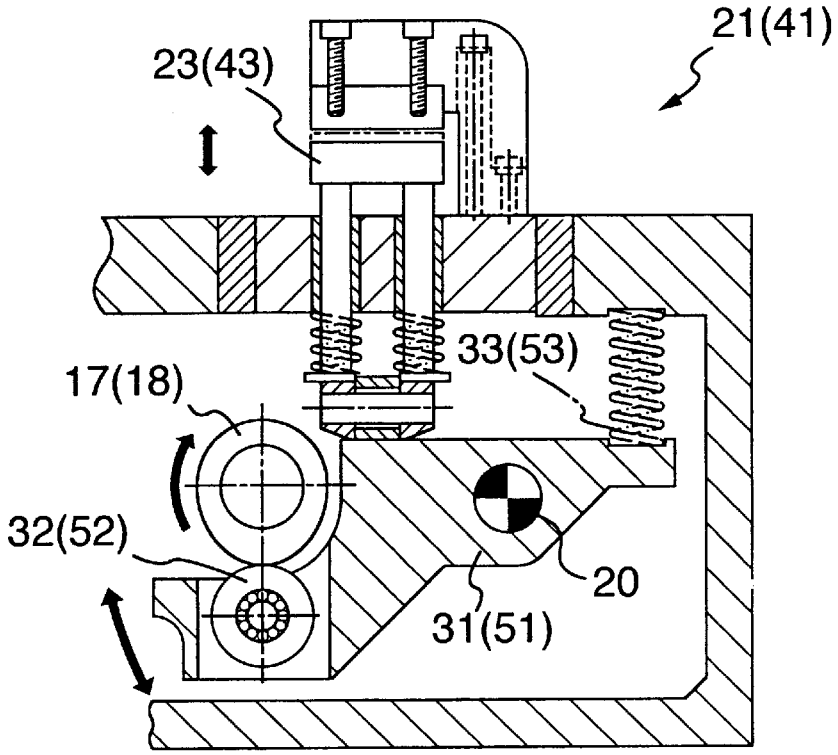
FIG. 8B is a vertical cross sectional view which shows an inner structure of the feeding apparatus in accordance with the embodiment as seen from a 8B direction in FIG. 2.

Then, as means (the first gripper sliding apparatus) for operatively connecting the first cam 16 to the first gripper apparatus 21, the apparatus 11 in accordance with the present embodiment has a swinging arm 64 which swings together with a rotation of the first cam 16, and a connecting rod 66 which connects the swinging arm 64 to the sliding block 61. The swinging arm 64 is mounted to a turret 63 rotatably placed to the apparatus housing 13 via a flange 81 and a bearing 82 shown in FIG. 5, and the turret 63 has cam followers 62 and 62*a* which is engaged with the cam surface of the first cam 16. These cam followers 62 and 62*a* rolls the cam surface of the cam together with the rotation of the first cam 16, rotate the turret 63 as shown in FIGS. 7A and 7B, and swings the arm 64 fixed thereto.

The connecting rod 66 connects one end thereof to the sliding block 61 and brings the other end into contact with a semi-spherical sliding barrel 65 provided on the swinging arm 64 in a rotatable and slidable manner, so that it is possible to maintain a connecting state of both the elements 61 and 64 even when an angle formed by the arm 64 and the sliding block 61 changed in correspondence to the swinging motion of the arm 64.

Further, the sliding barrel 65 can be slid in a longitudinal direction of the swinging arm 64 by a suitable slide mechanism, and the structure is made such as to change a distance from a center 64*a* of rotation of the arm 64. Because it is possible to change a moving amount of the sliding block 61 so as to adjust a feeding amount of the material 14 by changing a position of the sliding barrel 65.

Figure 10A:
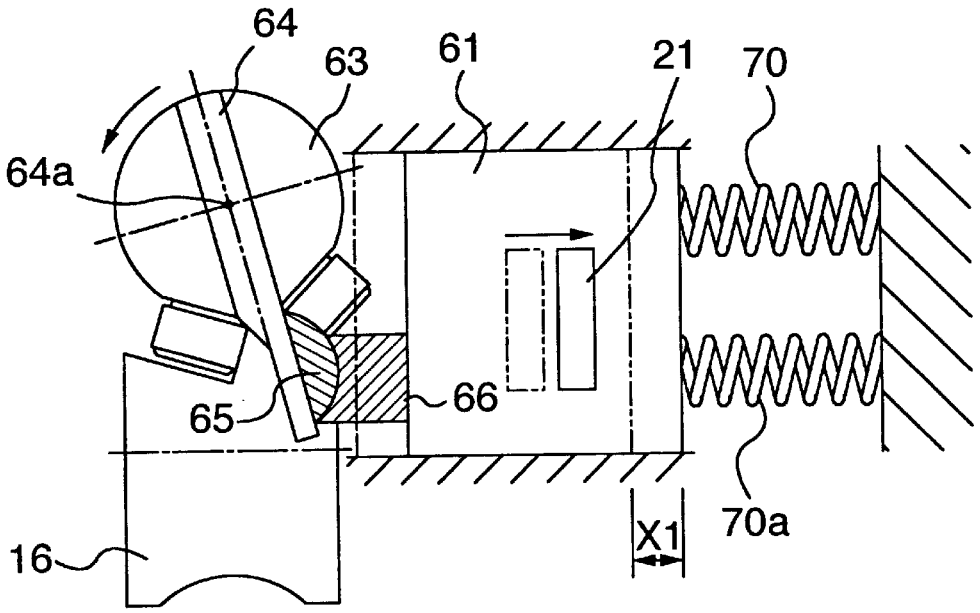
FIG. 10A is a plan view which shows an embodiment that a moving stroke of a sliding block is changed by the sliding mechanism (a case of increasing the stroke)
Figure 10B:
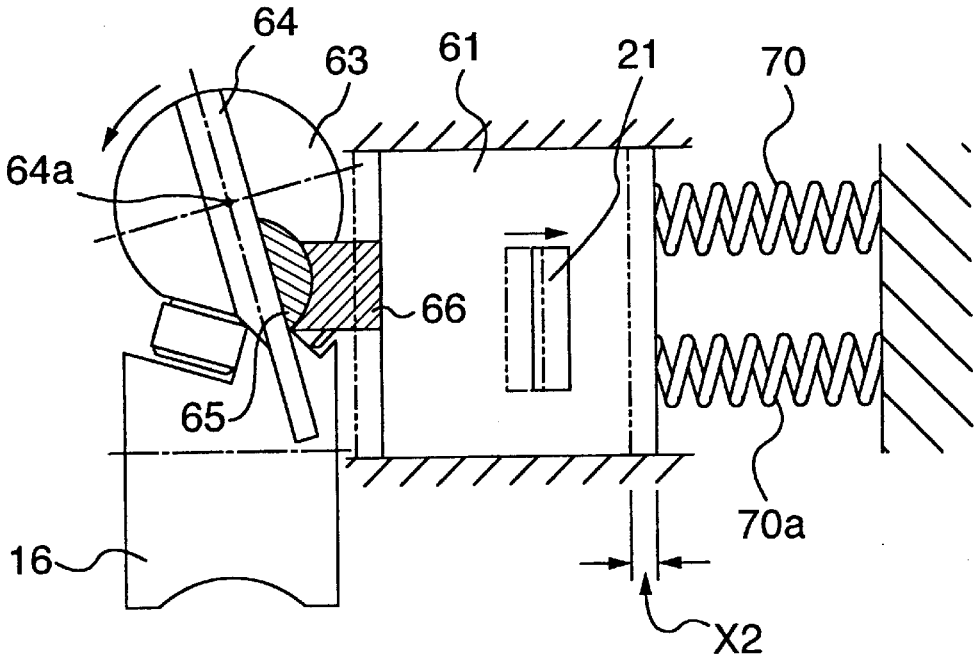
Fig 10B is a plan view which shows an embodiment that a moving stroke of a sliding block is changed by the sliding mechanism (a case of reducing the stroke).

For example, as shown in FIG. 10A, when shifting the sliding barrel 65 in a direction of a front end of the sliding arm 64 so as to move apart from the center 64*a* of rotation of the swinging arm 64, it is possible to increase a moving distance ×1 of the sliding block 61 so as to increase the feeding amount of the material 14. On the contrary, as shown in FIG. 10B, when moving the sliding barrel 65 near the center 64*a* of rotation of the swinging arm 64, it is possible to reduce a moving distance ×2 of the sliding block 61 so as to reduce a feeding amount of the material 14.

Figure 9A:
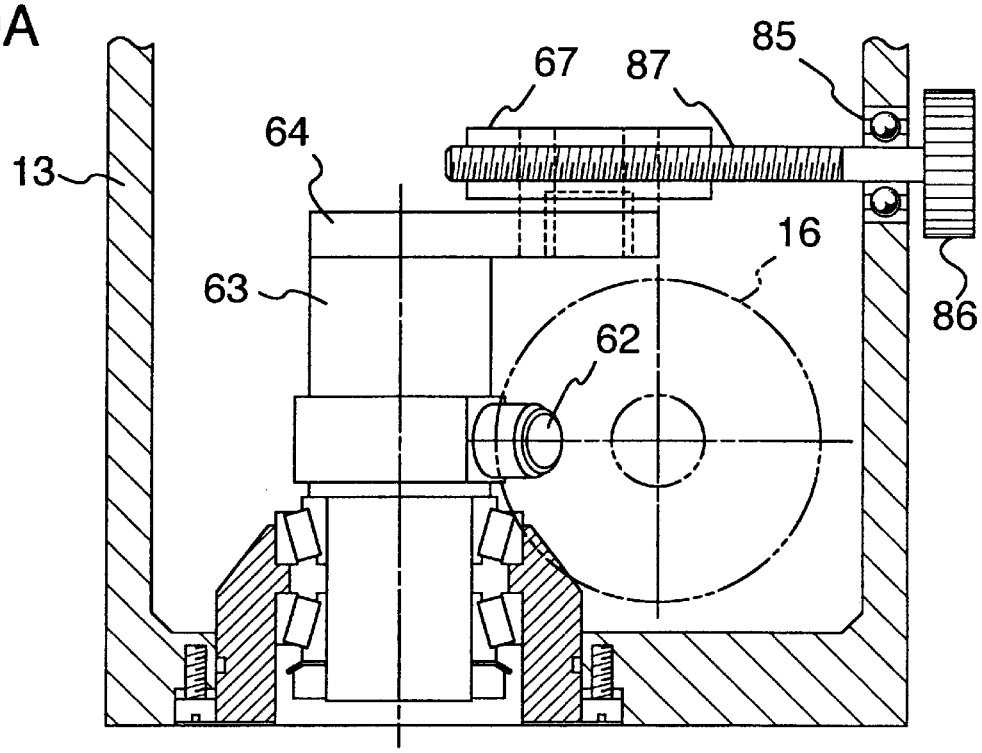
FIG. 9A is a front elevational view which shows a slide mechanism of a sliding barrel provided in the feeding apparatus in accordance with the embodiment.
Figure 9B:
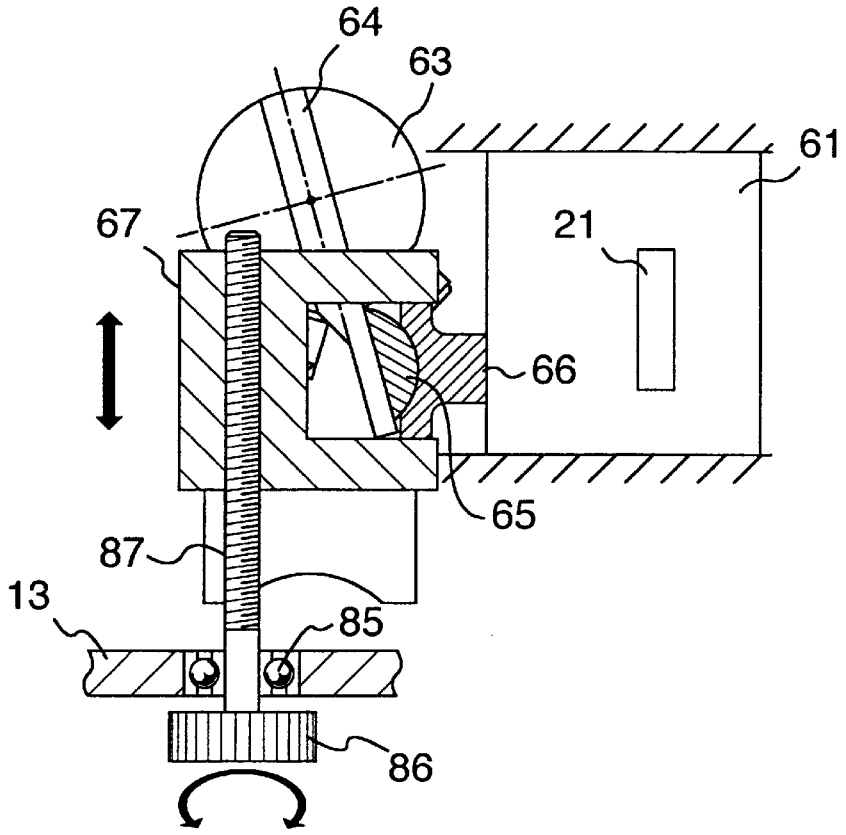
FIG. 9B is a plan view which shows a slide mechanism of a sliding barrel provided in the feeding apparatus in accordance with the embodiment.

A sliding mechanism of the barrel 65 can be constituted, for example, by meshing a base 67 which holds the sliding barrel 65 and the connecting rod 66 with a male screw portion 87 of a feeding amount adjusting handle 86 fixed to the apparatus handle 13 via a bearing 85 as shown in FIGS. 9A and 9B. When rotating the handle 86, the base 67 moves in a longitudinal direction of the swinging arm 64 so as to shift the sliding barrel 65. In this case, the structure is made such that a connecting point between the connecting rod 66 and the sliding block 61 can be shifted in correspondence to the sliding operation of the barrel 65.

Further, in this feeding apparatus 11, as shown in FIGS. 7A and 7B, there is provided coil springs 70 and 70*a* which urges the sliding block 61 in a returning direction (a direction opposite to a direction of forwarding the material; a leftward direction in FIGS. 6A to 6D and 7A to 7B). These springs 70 and 70*a* serves a function of returning the sliding block 61 and the first gripper apparatus 21 to an original position (FIGS. 7A, 6A and 6D) prior to the forwarding, and performs an operation of always pressing the sliding block 61 to the swinging arm 64 during the operation of the apparatus 11, so that the respective members which realize the forwarding of the material from the first cam 16 to the sliding block 61 due to the urging force of the springs 70 and 70*a,* that is, the respective members comprising the first cam 16, the cam follower 62 (the turret 63), the swinging arm 64, the sliding barrel 65, the connecting rod 66 and the sliding block 61 are always closely attached to each other, whereby it is possible to prevent the feeding error of the material from generating due to the gap (play) which may exist between the respective members.

Means for connecting the second cam 17 to the first movable gripper 23 (a first gripper operating apparatus) and means for connecting the third cam 18 to the second movable gripper 43 (a second gripper operating apparatus) are provided with movable gripper supporting rods (a first movable gripper supporting rod 24 and a second movable gripper supporting rod 44) which are provided in such a manner as to be movable between the clamping position and the unclamping position, and lift arms (a first lift arm 31 and a second lift arm 51) which swing together with a rotation of the second cam 17 or the third cam 18 so as to vertically move the movable gripper supporting rods 24 and 44, as shown in FIGS. 4A, 4B, 8A and 8B.

The respective movable gripper supporting rods 24 and 44 are respectively constituted by two rods 24 and 24*a,* and 44 and 44*a,* and the first movable gripper supporting rods 24 and 24*a* are placed in the sliding block 61 and the second movable gripper supporting rods 44 and 44*a* are placed in the apparatus housing 13, respectively in such a manner as to move in a vertical direction. The first movable gripper 23 and the second movable gripper 43 are respectively mounted at the upper ends of these rods 24, 24*a,* 44 and 44*a,* and contact elements 26 and 46 which are brought into contact with the upper surfaces of the respective lift arms 31 and 51 are provided at the lower ends thereof. Further, in order to always keep contact between the lift arms 31 and 51 so as to securely perform the clamping and unclamping operation of the material, the rods 24, 24*a,* 44 and 44*a* are respectively urged downward by the springs 25, 25*a,* 45 and 25*a*. Further, in particular, the contact element 26 of the first movable gripper supporting rod is structured such as to rotate the upper surface 35 of the first lift arm 31 together with the sliding operation of the sliding block 61.

On the contrary, the lift arms 31 and 51 are provided in such a manner as to freely swing around a common supporting shaft 20 placed in the housing 13 as shown in FIG. 3, are respectively provided with cam followers 32 and 52 which are respectively brought into rolling contact with the second cam 17 and the third cam 18, at the front ends thereof, and have coil springs 33 and 53 which respectively urge the cam followers 32 and 52 toward the second and third cams 17 and 18. Further, in particular, the first lift arm 31 operating the first movable gripper 23 forms an upper surface 35 thereof wider with respect to a moving direction (a lateral direction in the drawing) of the sliding block 61 as is understood from FIG. 8A, and is structured such that the contact element 26 of the first movable gripper supporting rod can roll on the upper surface 35.

Accordingly, the first gripper apparatus 21 (the first stationary gripper 22, the first movable gripper 23 and the supporting rod 24) can move in the transfer direction of the material (in a lateral direction in FIG. 8A) together with the sliding block 61 while maintaining its state without relation to the swinging state of the first lift arm 31, that is, whether the first gripper apparatus 21 is in a clamping state or in an unclamping state.

In accordance with the apparatus 11 of the present invention, since it is possible to always press the sliding block 61 to the swinging arm 64 during the forwarding operation of the material 14 and the returning operation of the gripper 21 so as to improve a close attachment between the members between the first cam 16 and the sliding block 61 which oscillate the first gripper apparatus 21, it is possible to cancel a feeding error due to the gap (play) existing between the members and realize a feeding operation at a significantly higher accurate in comparison with the conventional feeding apparatus which is driven by mechanically restricting both of the forwarding and returning operations. Further, since the operating members are always driven in a close attached state, there is a little possibility of generating a vibration and a sound, so that a high speed operation can be performed. Further, since a connecting structure between the cam apparatus and each of the gripper apparatuses is relatively simple, it is possible to reduce a manufacture cost for the apparatus, troubles are reduced, and a maintenance can be easily performed, so that it is advantageous in view of a running cost.

A kind and a shape of the material to be subjected by the present invention are not limited. It is possible to construct an apparatus for transferring, for example, a linear material (wire material) in addition to the plate-like material on the basis of the present invention. In this case, in order to correspond to the material shape of such a linear material, it is possible to suitably change the shape of the grippers (the stationary grippers 22 and 42 and the movable grippers 23 and 43).

What is claimed is:

1. A material feeding apparatus comprising:

a first gripper apparatus which performs material clamping and unclamping operations by a first stationary gripper and a first movable gripper;

a second gripper apparatus which performs material clamping and unclamping operations by a second stationary gripper and a second movable gripper;

a sliding block which supports said first gripper apparatus and can oscillate in a material transfer direction;

a cam apparatus having a first cam which is fixed to an input shaft continuously rotated in one direction and has a predetermined cam surface shape for converting a rotating motion of said input shaft into a linear motion of said sliding block, a second cam which is fixed to said input shaft and moves said first movable gripper between a clamping position at which said first movable gripper is moved near said first stationary gripper and an unclamping position at which said first movable gripper is moved apart from said first stationary gripper and a third cam which is fixed to said input shaft and moves said second movable gripper between a clamping position at which said second movable gripper is moved near said second stationary gripper and an unclamping position at which said second movable gripper is moved apart from said second stationary gripper;

a first gripper sliding apparatus having a swinging arm which swings in correspondence to a rotation of said first cam, and connecting means which operatively connects said swinging arm to said sliding block so as to convert a swing motion of said swinging arm into a linear motion of the sliding block;

a first gripper operating apparatus which operatively connects said second cam to said first movable gripper;

a second gripper operating apparatus which operatively connects said third cam to said second movable gripper; and first urging means which always urges so that said sliding block, said connecting means and said swinging arm are closely connected to each other along a transfer path of a force from said first cam to said sliding block.

2. A material feeding apparatus as claimed in claim 1, wherein said first gripper sliding apparatus is provided with a turret which swingably supports said swinging arm, and a cam follower which is rotatably placed in said turret and rotates a cam surface of said first cam, said connecting means includes a sliding barrel which is placed in said swinging arm in such a manner as to change a distance from a center of rotation of said swinging arm, and a connecting member which is rotatably and slidably brought into contact with said sliding barrel so as to connect said swinging arm to said sliding block via said sliding barrel, said first gripper operating apparatus is provided with a first movable gripper supporting rod which is placed in said sliding block in such a manner as to move between said clamping position and said unclamping position, and a first lift arm which swings together with the rotation of the second cam so as to move said first movable gripper supporting rod forward and rearward, said first movable gripper supporting rod is provided with second urging means which urges said rod toward an engaging surface of said first lift arm, and a rolling element which is brought into rolling contact with the engaging surface of said first lift arm in such a manner as to move together with said sliding block, in one end portion thereof, said second gripper operating apparatus is provided with a second movable gripper supporting rod which is placed in an apparatus housing in such a manner as to move between said clamping position and said unclamping position, and a second lift arm which swings together with a rotation of the third cam so as to move said second movable gripper supporting rod forward and rearward, said first and second lift arms have cam followers which are respectively brought into rolling contact with said second and third cams, and third urging means which respectively urge these cam followers toward said second and third cams, and said first urging means includes a spring which urges said sliding block in any one of a feeding direction and a returning direction of the material.

* * * * *